US008484829B2

(12) United States Patent
Manoukian et al.

(10) Patent No.: US 8,484,829 B2
(45) Date of Patent: Jul. 16, 2013

(54) METHODS FOR MANUFACTURING MAGNETIC COMPONENTS HAVING LOW PROBILE LAYERED COIL AND CORES

(75) Inventors: Daniel Minas Manoukian, San Ramon, CA (US); Robert James Bogert, Lake Worth, FL (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 12/724,490

(22) Filed: Mar. 16, 2010

(65) Prior Publication Data

US 2010/0171581 A1 Jul. 8, 2010

Related U.S. Application Data

(63) Continuation of application No. 11/519,349, filed on Sep. 12, 2006, now Pat. No. 7,791,445.

(51) Int. Cl.
*H01F 7/127* (2006.01)
*H01R 9/16* (2006.01)

(52) U.S. Cl.
USPC ..... 29/602.1; 29/606; 29/607; 29/609; 29/830; 29/842; 361/746

(58) Field of Classification Search
USPC ..... 29/602.1, 606, 607, 609, 600, 601, 29/830, 842, 884; 343/895; 361/737, 746; 336/200
See application file for complete search history.

(56) References Cited

U.S. PATENT DOCUMENTS

| | | | |
|---|---|---|---|
| 2,391,563 | A | 12/1945 | Goldberg |
| 3,255,512 | A | 6/1966 | Lochner et al. |
| 4,072,780 | A | 2/1978 | Zillman |
| 4,313,152 | A | 1/1982 | Vranken |
| 4,322,698 | A | 3/1982 | Takahashi et al. |
| 4,498,067 | A | 2/1985 | Kumokawa et al. |
| 4,543,553 | A | 9/1985 | Mandai et al. |
| 4,689,594 | A | 8/1987 | Kawabata et al. |
| 4,750,077 | A | 6/1988 | Amagasa |
| 4,758,808 | A | 7/1988 | Sasaki et al. |
| 4,803,425 | A | 2/1989 | Swanberg |
| 4,873,757 | A | 10/1989 | Williams |
| 5,032,815 | A | 7/1991 | Kobayashi et al. |
| 5,045,380 | A | 9/1991 | Kobayashi et al. |

(Continued)

FOREIGN PATENT DOCUMENTS

| | | | |
|---|---|---|---|
| DE | 102005039379 | A1 | 3/2007 |
| EP | 0655754 | A1 | 5/1995 |

(Continued)

OTHER PUBLICATIONS

International Search Report and Written Opinion of PCT/US2010/032787; Jul. 14, 2010; 20 pages.

(Continued)

*Primary Examiner* — A. Dexter Tugbang
(74) *Attorney, Agent, or Firm* — Armstrong Teasdale LLP

(57) ABSTRACT

Methods of manufacturing low profile magnetic components configured as a power management devices for an electrical system of an electronic device involve prefabricated coil windings assembled with a plurality of flexible dielectric sheet layers, and laminating the plurality of flexible dielectric sheets around the prefabricated coil windings to form a dielectric body having a low profile chip configuration attachable to the electronic device.

32 Claims, 7 Drawing Sheets

U.S. PATENT DOCUMENTS 5,142,767 A * 9/1992 Adams et al. ..... 29/602.1
5,197,170 A * 3/1993 Senda et al. ..... 29/602.1 X
5,250,923 A 10/1993 Ushiro et al.
5,257,000 A 10/1993 Billings et al.
5,300,911 A 4/1994 Walters
5,463,717 A 10/1995 Takatori et al.
5,515,022 A 5/1996 Tashiro et al.
5,532,667 A 7/1996 Haertling et al.
5,572,180 A 11/1996 Huang et al.
5,574,470 A * 11/1996 de Vall ..... 343/895
5,631,822 A 5/1997 Silberkleit et al.
5,664,069 A 9/1997 Takatori et al.
5,761,791 A 6/1998 Bando
5,821,638 A 10/1998 Boys et al.
5,828,940 A 10/1998 Learman
5,849,355 A 12/1998 McHenry
5,875,541 A 3/1999 Kumeji et al.
5,896,078 A * 4/1999 Hayakawa et al. ..... 336/200
5,945,902 A 8/1999 Lipkes et al.
6,038,134 A 3/2000 Belter
6,054,914 A 4/2000 Abel et al.
6,107,907 A 8/2000 Leigh et al.
6,169,801 B1 1/2001 Levasseur et al.
6,198,374 B1 3/2001 Abel
6,198,375 B1 3/2001 Shafer
6,204,744 B1 3/2001 Shafer et al.
6,287,931 B1 9/2001 Chen
6,293,001 B1 9/2001 Uriu et al.
6,366,192 B2 4/2002 Person et al.
6,379,579 B1 4/2002 Harada
6,392,525 B1 5/2002 Kato et al.
6,420,953 B1 * 7/2002 Dadafshar ..... 336/200
6,449,829 B1 9/2002 Shafer
6,460,244 B1 10/2002 Shafer et al.
6,522,549 B2 * 2/2003 Kano et al. ..... 361/737
6,566,731 B2 5/2003 Ahn et al.
6,628,531 B2 9/2003 Dadafshar
6,631,545 B1 10/2003 Uriu et al.
6,653,196 B2 11/2003 Ahn et al.
6,658,724 B2 12/2003 Nakano et al.
6,710,692 B2 3/2004 Kato et al.
6,713,162 B2 3/2004 Takaya et al.
6,720,074 B2 4/2004 Zhang et al.
6,749,827 B2 6/2004 Smalley et al.
6,750,723 B2 6/2004 Yoshida et al.
6,791,445 B2 9/2004 Shibata et al.
6,794,052 B2 9/2004 Schultz et al.
6,797,336 B2 9/2004 Garvey et al.
6,808,642 B2 10/2004 Takaya et al.
6,817,085 B2 11/2004 Uchikoba et al.
6,835,889 B2 12/2004 Hiraoka et al.
6,859,130 B2 * 2/2005 Nakashima et al. ..... 336/200
6,864,201 B2 3/2005 Schultz et al.
6,879,238 B2 4/2005 Liu et al.
6,882,261 B2 4/2005 Moro et al.
6,885,276 B2 4/2005 Iha et al.
6,897,718 B2 5/2005 Yoshida et al.
6,903,641 B2 * 6/2005 Kondo et al. ..... 29/606 X
6,908,960 B2 6/2005 Takaya et al.
6,924,777 B2 * 8/2005 Reasoner et al. ..... 343/895 X
6,927,738 B2 8/2005 Senba et al.
6,936,233 B2 8/2005 Smalley et al.
6,946,944 B2 9/2005 Shafer et al.
6,949,237 B2 9/2005 Smalley et al.
6,952,355 B2 10/2005 Riggio et al.
6,971,391 B1 12/2005 Wang et al.
6,979,709 B2 12/2005 Smalley et al.
6,986,876 B2 1/2006 Smalley et al.
6,998,939 B2 2/2006 Nakayama et al.
7,008,604 B2 3/2006 Smalley et al.
7,019,391 B2 3/2006 Tran
7,034,091 B2 4/2006 Schultz et al.
7,034,645 B2 4/2006 Shafer et al.
7,041,620 B2 5/2006 Smalley et al.
7,048,999 B2 5/2006 Smalley et al.
7,069,639 B2 7/2006 Choi et al.
7,071,406 B2 7/2006 Smalley et al.
7,078,999 B2 7/2006 Uriu et al.
7,081,803 B2 7/2006 Takaya et al.
7,087,207 B2 8/2006 Smalley et al.
7,091,412 B2 8/2006 Wang et al.
7,091,575 B2 8/2006 Ahn et al.
7,105,596 B2 9/2006 Smalley et al.
7,108,841 B2 9/2006 Smalley et al.
7,127,294 B1 10/2006 Wang et al.
7,142,066 B1 11/2006 Hannah et al.
7,162,302 B2 1/2007 Wang et al.
7,187,263 B2 3/2007 Vinciarelli
7,205,069 B2 4/2007 Smalley et al.
7,213,915 B2 5/2007 Tsutsumi et al.
7,221,249 B2 5/2007 Shafer et al.
7,262,482 B2 8/2007 Ahn et al.
7,263,761 B1 9/2007 Shafer et al.
7,294,366 B2 11/2007 Renn et al.
7,319,599 B2 1/2008 Hirano et al.
7,330,369 B2 2/2008 Tran
7,339,451 B2 3/2008 Liu et al.
7,345,562 B2 3/2008 Shafer et al.
7,354,563 B2 4/2008 Smalley et al.
7,375,417 B2 5/2008 Tran
7,380,328 B2 6/2008 Ahn et al.
7,390,477 B2 6/2008 Smalley et al.
7,390,767 B2 6/2008 Smalley et al.
7,393,699 B2 7/2008 Tran
7,400,512 B2 7/2008 Hirano et al.
7,419,624 B1 9/2008 Smalley et al.
7,419,651 B2 9/2008 Smalley et al.
7,442,665 B2 10/2008 Schultz et al.
7,445,852 B2 11/2008 Maruko et al.
7,449,984 B2 11/2008 Kawarai
7,481,989 B2 1/2009 Smalley et al.
7,485,366 B2 2/2009 Ma et al.
7,489,537 B2 2/2009 Tran
7,525,406 B1 4/2009 Cheng
7,567,163 B2 7/2009 Dadafshar et al.
7,791,445 B2 9/2010 Manoukian et al.
2001/0016977 A1 8/2001 Moro et al.
2002/0009577 A1 1/2002 Takaya et al.
2003/0029830 A1 2/2003 Takaya et al.
2004/0174239 A1 9/2004 Shibata et al.
2004/0209120 A1 10/2004 Inoue et al.
2004/0210289 A1 10/2004 Wang et al.
2005/0007296 A1 * 1/2005 Endo et al. ..... 343/895
2005/0081374 A1 * 4/2005 Eckstein et al. ..... 29/601 X
2005/0151614 A1 7/2005 Dadafshar
2005/0184848 A1 8/2005 Yoshida et al.
2005/0188529 A1 9/2005 Uriu et al.
2006/0038651 A1 2/2006 Mizushima et al.
2007/0030108 A1 2/2007 Ishimoto et al.
2007/0057755 A1 3/2007 Suzuki et al.
2007/0175545 A1 8/2007 Urata et al.
2008/0001702 A1 1/2008 Brunner
2008/0061917 A1 3/2008 Manoukian et al.
2008/0110014 A1 5/2008 Shafer et al.
2008/0278275 A1 11/2008 Fouquet et al.
2008/0310051 A1 12/2008 Yan et al.
2009/0066454 A1 3/2009 Hansen
2009/0096565 A1 4/2009 Lanni
2010/0007457 A1 1/2010 Yan et al.
2010/0026443 A1 2/2010 Yan et al.
2010/0039200 A1 2/2010 Yan et al.
2010/0085139 A1 4/2010 Yan et al.
2010/0171579 A1 7/2010 Yan et al.
2010/0171581 A1 7/2010 Manoukian et al.
2010/0259351 A1 10/2010 Bogert et al.
2010/0259352 A1 10/2010 Yan et al.
2010/0277267 A1 11/2010 Bogert et al.

FOREIGN PATENT DOCUMENTS

EP 1150312 A2 10/2001
EP 1288975 A2 3/2003
EP 1288975 A3 4/2003
EP 1564761 A1 8/2005
JP 60176208 A 9/1985
JP 03008311 A * 1/1991
JP 06216538 8/1994
JP 07272932 10/1995

| | | | | |
|---|---|---|---|---|
| JP | 2700713 | | | 1/1998 |
| JP | 10106839 | | | 4/1998 |
| JP | 2000182872 | | | 6/2000 |
| JP | 3108931 | | | 11/2000 |
| JP | 3160685 | | | 4/2001 |
| JP | 2002043143 | | | 2/2002 |
| JP | 2002280745 | | | 9/2002 |
| JP | 2002313632 | | | 10/2002 |
| JP | 2002313632 | A | | 10/2002 |
| JP | 2004200468 | | | 7/2004 |
| JP | 2005129968 | | | 5/2005 |
| JP | 2005-217084 | | * | 8/2005 |
| JP | 2005217084 | A | | 8/2005 |
| KR | 20010014533 | | | 2/2001 |
| KR | 20020071285 | | | 9/2002 |
| KR | 20030081738 | | | 10/2003 |
| WO | 9205568 | | | 4/1992 |
| WO | 2005020254 | A2 | | 3/2005 |
| WO | 2006063081 | A2 | | 6/2006 |
| WO | 2009113775 | A2 | | 9/2009 |

OTHER PUBLICATIONS

International Search Report and Written Opinion of PCT/US2009/057471; Dec. 14, 2009; 14 pages.

International Search Report and Written Opinion of PCT/US2009/051005; Sep. 23, 2009; 15 pages.

Kim, S. et al; Electromagnetic Shielding Properties of Soft Magnetic Powder-Polymer Composite Films for the Application to Suppress Noise in the Radio Frequency Range; www.sciencedirect.com; Journal of Magnetism and Magnetic Materials 316 (2007) 472-474.

International Preliminary Report on Patentability and Written Opinion of PCT/US2010/032787; Nov. 17, 2011; 13 pages.

International Search Report and Written Opinion of PCT/US2011/024714; Apr. 21, 2011; 14 pages.

International Preliminary Report on Patentability and Written Opinion of PCT/US2009/057471; Apr. 21, 2011; 6 pages.

* cited by examiner

METHODS FOR MANUFACTURING MAGNETIC COMPONENTS HAVING LOW PROBILE LAYERED COIL AND CORES

CROSS REFERENCE TO RELATED APPLICATIONS

This application is a continuation application of U.S. patent application Ser. No. 11/519,349 filed Sep. 12, 2006.

BACKGROUND OF THE INVENTION

This invention relates generally to manufacturing of electronic components including magnetic cores, and more specifically to manufacturing of surface mount electronic components having magnetic cores and conductive coil windings.

A variety of magnetic components, including but not limited to inductors and transformers, include at least one conductive winding disposed about a magnetic core. Such components may be used as power management devices in electrical systems, including but not limited to electronic devices. Advancements in electronic packaging have enabled a dramatic reduction in size of electronic devices. As such, modern handheld electronic devices are particularly slim, sometimes referred to as having a low profile or thickness.

DETAILED DESCRIPTION OF THE INVENTION

Figure 1:
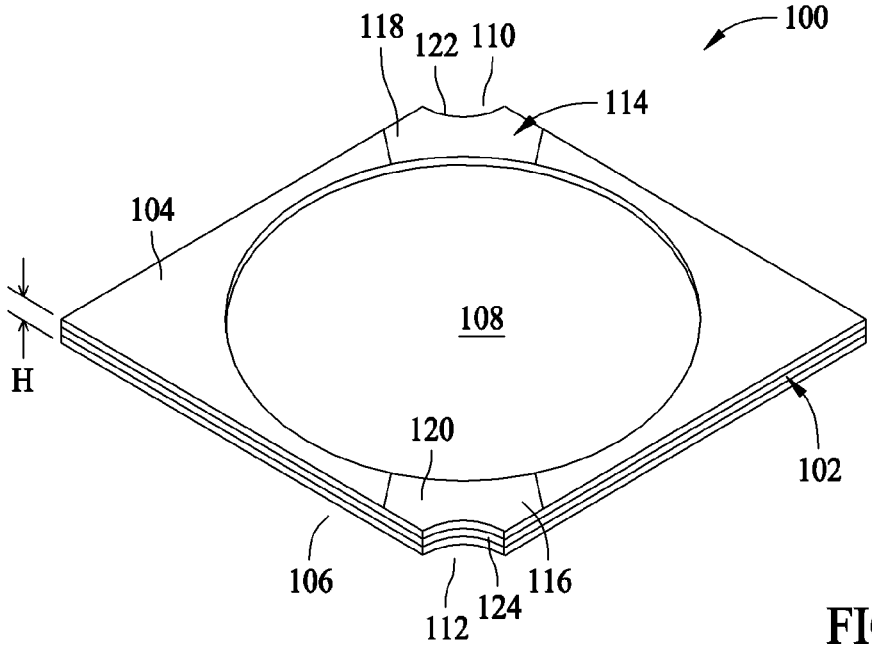
FIG. 1 is a perspective view of a magnetic component according to the present invention.

Manufacturing processes for electrical components have been scrutinized as a way to reduce costs in the highly competitive electronics manufacturing business. Reduction of manufacturing costs are particularly desirable when the components being manufactured are low cost, high volume components. In a high volume component, any reduction in manufacturing costs is, of course, significant. Manufacturing costs as used herein refers to material cost and labor costs, and reduction in manufacturing costs is beneficial to consumers and manufacturers alike. It is therefore desirable to provide a magnetic component of increased efficiency and improved manufacturability for circuit board applications without increasing the size of the components and occupying an undue amount of space on a printed circuit board.

Miniaturization of magnetic components to meet low profile spacing requirements for new products, including but not limited to hand held electronic devices such as cellular phones, personal digital assistant (PDA) devices, and other devices presents a number of challenges and difficulties. Particularly for devices having stacked circuit boards, which is now common to provide added functionality of such devices, a reduced clearance between the boards to meet the overall low profile requirements for the size of the device has imposed practical constraints that either conventional circuit board components may not satisfy at all, or that have rendered conventional techniques for manufacturing conforming devices undesirably expensive.

Such disadvantages in the art are effectively overcome by virtue of the present invention. For a full appreciation of the inventive aspects of exemplary embodiments of the invention described below, the disclosure herein will be segmented into sections, wherein Part I is an introduction to conventional magnetic components and their disadvantages; Part II discloses an exemplary embodiments of a component device according to the present invention and a method of manufacturing the same; and Part III discloses an exemplary embodiments of a modular component device according to the present invention and a method of manufacturing the same.

I. INTRODUCTION TO LOW PROFILE MAGNETIC COMPONENTS

Conventionally, magnetic components, including but not limited to inductors and transformers, utilize a conductive winding disposed about a magnetic core. In existing components for circuit board applications, magnetic components may be fabricated with fine wire that is helically wound on a low profile magnetic core, sometimes referred to as a drum. For small cores, however, winding the wire about the drum is difficult. In an exemplary installation, a magnetic component having a low profile height of less than 0.65 mm is desired. Challenges of applying wire coils to cores of this size tends to increase manufacturing costs of the component and a lower cost solution is desired.

Efforts have been made to fabricate low profile magnetic components, sometimes referred to as chip inductors, using deposited metallization techniques on a high temperature organic dielectric substrate (e.g. FR-4, phenolic or other material) and various etching and formation techniques for forming the coils and the cores on FR4 board, ceramic substrate materials, circuit board materials, phoenlic, and other rigid substrates. Such known techniques for manufacturing such chip inductors, however, involve intricate multi-step manufacturing processes and sophisticated controls. It would be desirable to reduce the complexity of such processes in certain manufacturing steps to accordingly reduce the requisite time and labor associated with such steps. It would further be desirable to eliminate some process steps altogether to reduce manufacturing costs.

II. MAGNETIC DEVICES HAVING INTEGRATED COIL LAYERS

FIG. 1 is a top plan view of a first illustrative embodiment of an magnetic component or device 100 in which the benefits of the invention are demonstrated. In an exemplary embodiment the device 100 is an inductor, although it is appreciated that the benefits of the invention described below may accrue to other types of devices. While the materials and techniques described below are believed to be particularly advantageous for the manufacture of low profile inductors, it is recognized that the inductor 100 is but one type of electrical component in which the benefits of the invention may be appreciated. Thus, the description set forth below is for illustrative purposes only, and it is contemplated that benefits of the invention accrue to other sizes and types of inductors as well as other passive electronic components, including but not limited to transformers. Therefore, there is no intention to limit practice of the inventive concepts herein solely to the illustrative embodiments described herein and illustrated in the Figures.

According to an exemplary embodiment of the invention, the inductor 100 may have a layered construction, described in detail below, that includes a coil layer 102 extending between outer dielectric layers 104, 106. A magnetic core 108 extends above, below and through a center of the coil (not shown in FIG. 1) in the manner explained below. As illustrated in FIG. 1, the inductor 100 is generally rectangular in shape, and includes opposing corner cutouts 110, 112. Surface mount terminations 114, 116 are formed adjacent the corner cutouts 110, 112, and the terminations 114, 116 each include planar termination pads 118, 120 and vertical surfaces 122, 124 that are metallized, for example, with conductive plating. When the surface mounts pads 118, 120 are connected to circuit traces on a circuit board (not shown), the metallized vertical surfaces 122, 124 establish a conductive path between the termination pads 118, 120 and the coil layer 102. The surface mount terminations 114, 116 are sometimes referred to as castellated contact terminations, although other termination structures such as contact leads (i.e. wire terminations), wrap-around terminations, dipped metallization terminations, plated terminations, solder contacts and other known connection schemes may alternatively be employed in other embodiments of the invention to provide electrical connection to conductors, terminals, contact pads, or circuit terminations of a circuit board (not shown).

In an exemplary embodiment, the inductor 100 has a low profile dimension H that is less than 0.65 mm in one example, and more specifically is about 0.15 mm. The low profile dimension H corresponds to a vertical height of the inductor 100 when mounted to the circuit board, measured in a direction perpendicular to the surface of the circuit board. In the plane of the board, the inductor 100 may be approximately square having side edges about 2.5 mm in length in one embodiment. While the inductor 100 is illustrated with a rectangular shape, sometimes referred to as a chip configuration, and also while exemplary dimensions are disclosed, it is understood that other shapes and greater or lesser dimensions may alternatively utilized in alternative embodiments of the invention.

Figure 2:
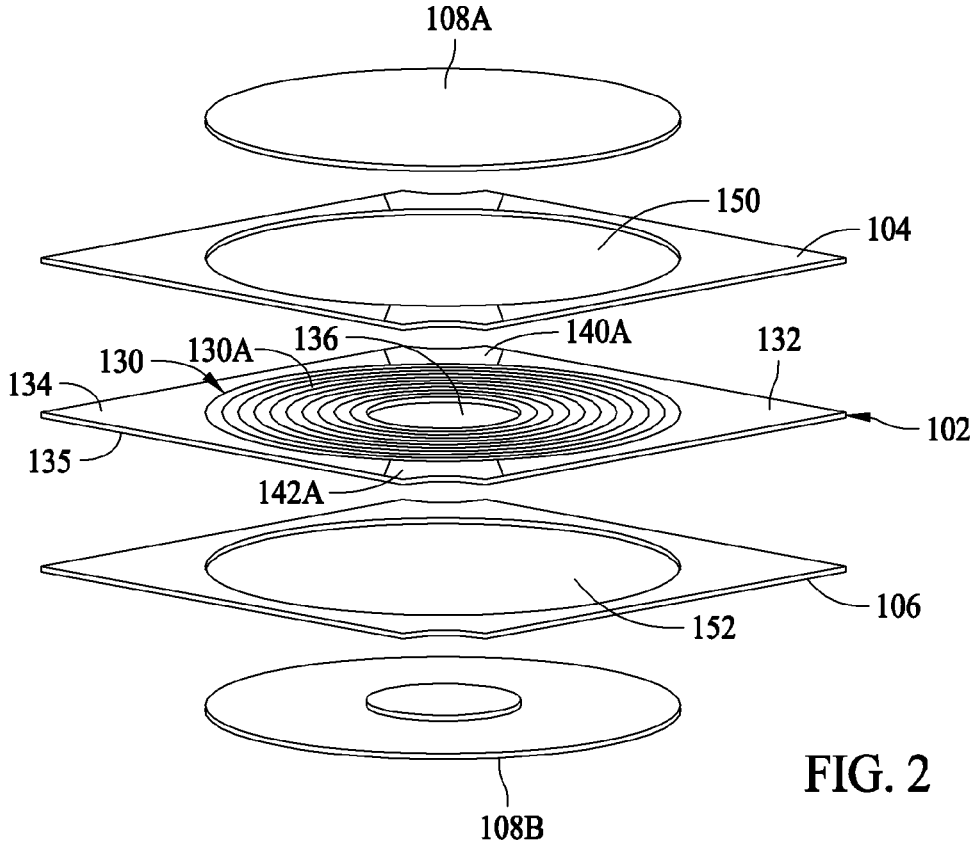
FIG. 2 is an exploded view of the device shown in FIG. 1.
Figure 3:
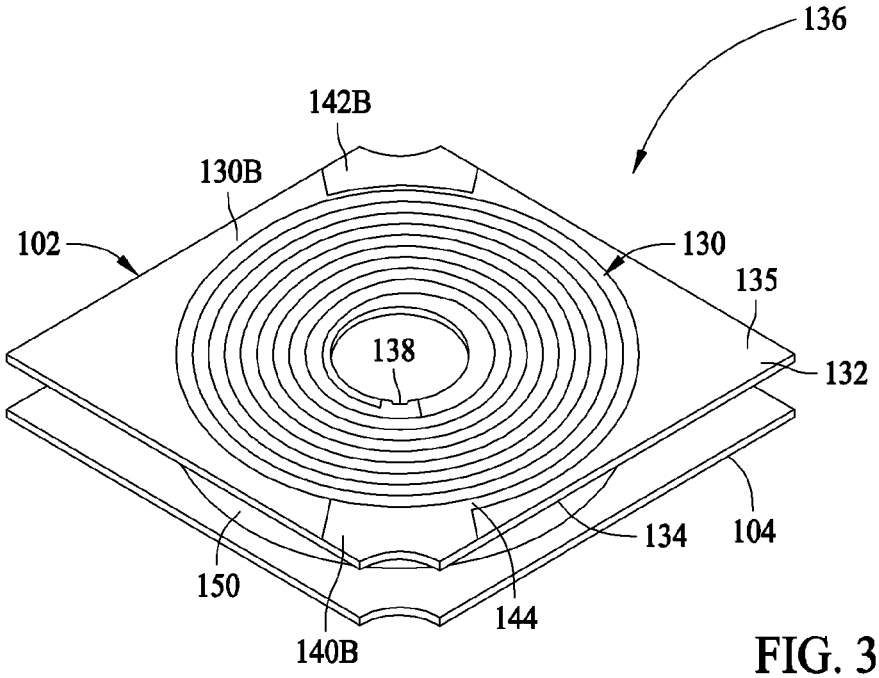
FIG. 3 is a partial exploded view of a portion of the device shown in FIG. 2.

FIG. 2 is an exploded view of the inductor 100 wherein the coil layer 102 is shown extending between the upper and lower dielectric layers 104 and 106. The coil layer 102 includes a coil winding 130 extending on a substantially planar base dielectric layer 132. The coil winding 130 includes a number of turns to achieve a desired effect, such as, for example, a desired inductance value for a selected end use application of the inductor 100. The coil winding 130 is arranged in two portions 130A and 130B on each respective opposing surface 134 (FIG. 2) and 135 (FIG. 3) of the base layer 132. That is, a double sided coil winding 130 including portions 130A and 130B extends in the coil layer 102. Each coil winding portion 130A and 130B extends in a plane on the major surfaces 134, 135 of the base layer 132.

The coil layer 102 further includes termination pads 140A and 142A on the first surface 134 of the base layer 132, and termination pads 140B and 142B on the second surface 135 of the base layer 132. An end 144 of the coil winding portion 130B is connected to the termination pad 140B on the surface 135 (FIG. 3), and an end of the coil winding portion 130A is connected to the termination pad 142A on the surface 134 (FIG. 2). The coil winding portions 130A and 130B may be interconnected in series by a conductive via 138 (FIG. 3) at the periphery of the opening 136 in the base layer 132. Thus, when the terminations 114 and 116 are coupled to energized circuitry, a conductive path is established through the coil winding portions 130A and 130B between the terminations 114 and 116.

The base layer 132 may be generally rectangular in shape and may be formed with a central core opening 136 extending between the opposing surfaces 134 and 135 of the base layer 132. The core openings 136 may be formed in a generally circular shape as illustrated, although it is understood that the opening need not be circular in other embodiments. The core opening 136 receives a magnetic material described below to form a magnetic core structure for the coil winding portions 130A and 130B.

The coil portions 130A and 130B extends around the perimeter of the core opening 136 and with each successive turn of the coil winding 130 in each coil winding portion 130A and 130B, the conductive path established in the coil layer 102 extends at an increasing radius from the center of the opening 136. In an exemplary embodiment, the coil winding 130 extends on the base layer 132 for a number of turns in a winding conductive path atop the base layer 132 on the surface 134 in the coil winding portion 130A, and also extends for a number of turns below the base layer 132 on the surface 135 in the coil winding portion 130B. The coil winding 130 may extend on each of the opposing major surfaces 134 and 135 of the base layer 132 for a specified number of turns, such as ten turns on each side of the base layer 132 (resulting in twenty total turns for the series connected coil portions 130A and 130B). In an illustrative embodiment, a twenty turn coil winding 130 produces an inductance value of about 4 to 5 μH, rendering the inductor 100 well suited as a power inductor for low power applications. The coil winding 130 may alternatively be fabricated with any number of turns to customize the coil for a particular application or end use.

As those in the art will appreciate, an inductance value of the inductor 100 depends primarily upon a number of turns of wire in the coil winding 130, the material used to fabricate the coil winding 130, and the manner in which the coil turns are distributed on the base layer 132 (i.e., the cross sectional area of the turns in the coil winding portions 130A and 130B). As such, inductance ratings of the inductor 100 may be varied considerably for different applications by varying the number of coil turns, the arrangement of the turns, and the cross sectional area of the coil turns. Thus, while ten turns in the coil winding portions 130A and 130B are illustrated, more or less turns may be utilized to produce inductors having inductance values of greater or less than 4 to 5 μH as desired. Additionally, while a double sided coil is illustrated, it is understood that a single sided coil that extends on only one of the base layer surfaces 134 or 135 may likewise be utilized in an alternative embodiment.

The coil winding 130 may be, for example, an electroformed metal foil which is fabricated and formed independently from the upper and lower dielectric layers 104 and 106. Specifically, in an illustrative embodiment, the coil portions 130A and 130B extending on each of the major surfaces 134, 135 of the base layer 132 may be fabricated according to a known additive process, such as an electro-forming process wherein the desired shape and number of turns of the coil winding 130 is plated up, and a negative image is cast on a photo-resist coated base layer 132. A thin layer of metal, such as copper, nickel, zinc, tin, aluminum, silver, alloys thereof (e.g., copper/tin, silver/tin, and copper/silver alloys) may be subsequently plated onto the negative image cast on the base layer 132 to simultaneously form both coil portions 130A and 130B. Various metallic materials, conductive compositions, and alloys may be used to form the coil winding 130 in various embodiments of the invention.

Separate and independent formation of the coil winding 130 from the dielectric layers 104 and 106 is advantageous in comparison to known constructions of chip inductors, for example, that utilize metal deposition techniques on inorganic substrates and subsequently remove or subtract the deposited metal via etching processes and the like to form a coil structure. For example, separate and independent formation of the coil winding 130 permits greater accuracy in the control and position of the coil winding 130 with respect to the dielectric layers 104, 106 when the inductor 100 is constructed. In comparison to etching processes of known such devices, independent formation of the coil winding 130 also permits greater control over the shape of the conductive path of the coil. While etching tends to produce oblique or sloped side edges of the conductive path once formed, substantially perpendicular side edges are possible with electroforming processes, therefore providing a more repeatable performance in the operating characteristics of the inductor 100. Still further, multiple metals or metal alloys may be used in the separate and independent formation process, also to vary performance characteristics of the device.

While electroforming of the coil winding 130 in a manner separate and distinct from the dielectric layers 104 and 106 is believed to be advantageous, it is understood that the coil winding 130 may be alternatively formed by other methods while still obtaining some of the advantages of the present invention. For example, the coil winding 130 may be an electro deposited metal foil applied to the base layer 132 according to known techniques. Other additive techniques such as screen printing and deposition techniques may also be utilized, and subtractive techniques such as chemical etching, plasma etching, laser trimming and the like as known in the art may be utilized to shape the coils.

The upper and lower dielectric layers 104, 106 overlie and underlie, respectively, the coil layer 102. That is, the coil layer 102 extends between and is intimate contact with the upper and lower dielectric layers 104, 106. In an exemplary embodiment, the upper and lower dielectric layers 104 and 106 sandwich the coil layer 102, and each of the upper and lower dielectric layers 104 and 106 include a central core opening 150, 152 formed therethrough. The core openings 150, 152 may be formed in generally circular shapes as illustrated, although it is understood that the openings need not be circular in other embodiments.

The openings 150, 152 in the respective first and second dielectric layers 104 and 106 expose the coil portions 130A and 130B and respectively define a receptacle above and below the double side coil layer 102 where the coil portions 130A and 130B extend for the introduction of a magnetic material to form the magnetic core 108. That is, the openings 150, 152 provide a confined location for portions 108A and 108B of the magnetic core.

Figure 4:
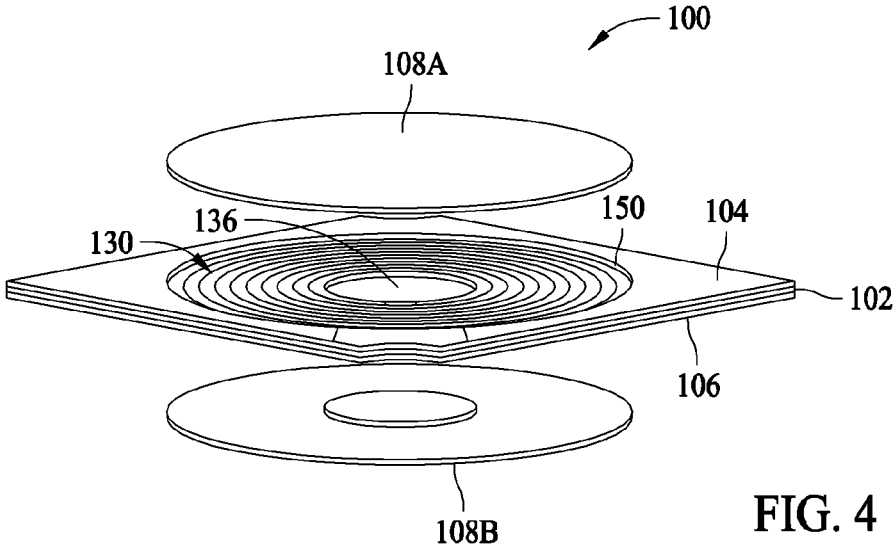
FIG. 4 is another exploded view of a the device shown in FIG. 1 in a partly assembled condition.

FIG. 4 illustrates the coil layer 102 and the dielectric layers 104 and 106 in a stacked relation. The layers 102, 104, 106 may be secured to one another in a known manner, such as with a lamination process. As shown in FIG. 4, the coil winding 130 is exposed within the core openings 150 and 152 (FIG. 2), and the core pieces 108A and 108B may be applied to the openings 150, 152 and the opening 136 in the coil layer 102.

In an exemplary embodiment, the core portions 108A and 108B are applied as a powder or slurry material to fill the openings 150 and 152 in the upper and lower dielectric layers 104 and 106, and also the core opening 136 (FIGS. 2 and 3) in the coil layer 102. When the core openings 136, 150 and 152 are filled, the magnetic material surrounds or encases the coil portions 130A and 130B. When cured, core portions 108A and 108B form a monolithic core piece and the coil portions 130A and 130B are embedded in the core 108, and the core pieces 108A and 108B are flush mounted with the upper and lower dielectric layers 104 and 106. That is, the core pieces 108A and 108B have a combined height extending through the openings that is approximately the sum of the thicknesses of the layers 104, 106 and 132. In other words, the core pieces 108A and 108B also satisfy the low profile dimension H (FIG. 1). The core 108 may be fabricated from a known magnetic permeable material, such as a ferrite or iron powder in one embodiment, although other materials having magnetic permeability may likewise be employed.

In an illustrative embodiment, the first and second dielectric layers 104 and 106, and the base layer 132 of the coil layer 102 are each fabricated from polymer based dielectric films. The upper and lower insulating layers 104 and 106 may include an adhesive film to secure the layers to one another and to the coil layer 102. Polymer based dielectric films are advantageous for their heat flow characteristics in the layered construction. Heat flow within the inductor 100 is proportional to the thermal conductivity of the materials used, and heat flow may result in power losses in the inductor 100. Thermal conductivity of some exemplary known materials are set forth in the following Table, and it may be seen that by reducing the conductivity of the insulating layers employed, heat flow within the inductor 100 may be considerably reduced. Of particular note is the significantly lower thermal conductivity of polyimide, which may be employed in illustrative embodiments of the invention as insulating material in the layers 104, 106 and 132.

| Substrate Thermal Conductivity's (W/mK) | |
|---|---|
| Alumina ($Al_2O_3$) | 19 |
| Forsterite ($2MgO—SiO_2$) | 7 |
| Cordierite ($2MgO—2Al_2O_3—5SiO_2$) | 1.3 |
| Steatite ($2MgO—SiO_2$) | 3 |
| Polyimide | 0.12 |
| FR-4 Epoxy Resin/Fiberglass Laminate | 0.293 |

One such polyimide film that is suitable for the layers 104, 106 and 132 is commercially available and sold under the trademark KAPTON® from E. I. du Pont de Nemours and Company of Wilmington, Del. It is appreciated, however, that in alternative embodiments, other suitable electrical insulation materials (polyimide and non-polyimide) such as CIRLEX® adhesiveless polyimide lamination materials, UPILEX® polyimide materials commercially available from Ube Industries, Pyrolux, polyethylene naphthalendicarboxylate (sometimes referred to as PEN), Zyvrex liquid crystal polymer material commercially available from Rogers Corporation, and the like may be employed in lieu of KAPTON®. It is also recognized that adhesiveless materials may be employed in the first and second dielectric layers 104 and 106. Pre-metallized polyimide films and polymer-based films are also available that include, for example, copper foils and films and the like, that may be shaped to form specific circuitry, such as the winding portions and the termination pads, for example, of the coil layers, via a known etching process, for example.

Polymer based films also provide for manufacturing advantages in that they are available in very small thicknesses, on the order of microns, and by stacking the layers a very low profile inductor 100 may result. The layers 104, 106 and 132 may be adhesively laminated together in a straightforward manner, and adhesiveless lamination techniques may alternatively be employed.

Figure 5:
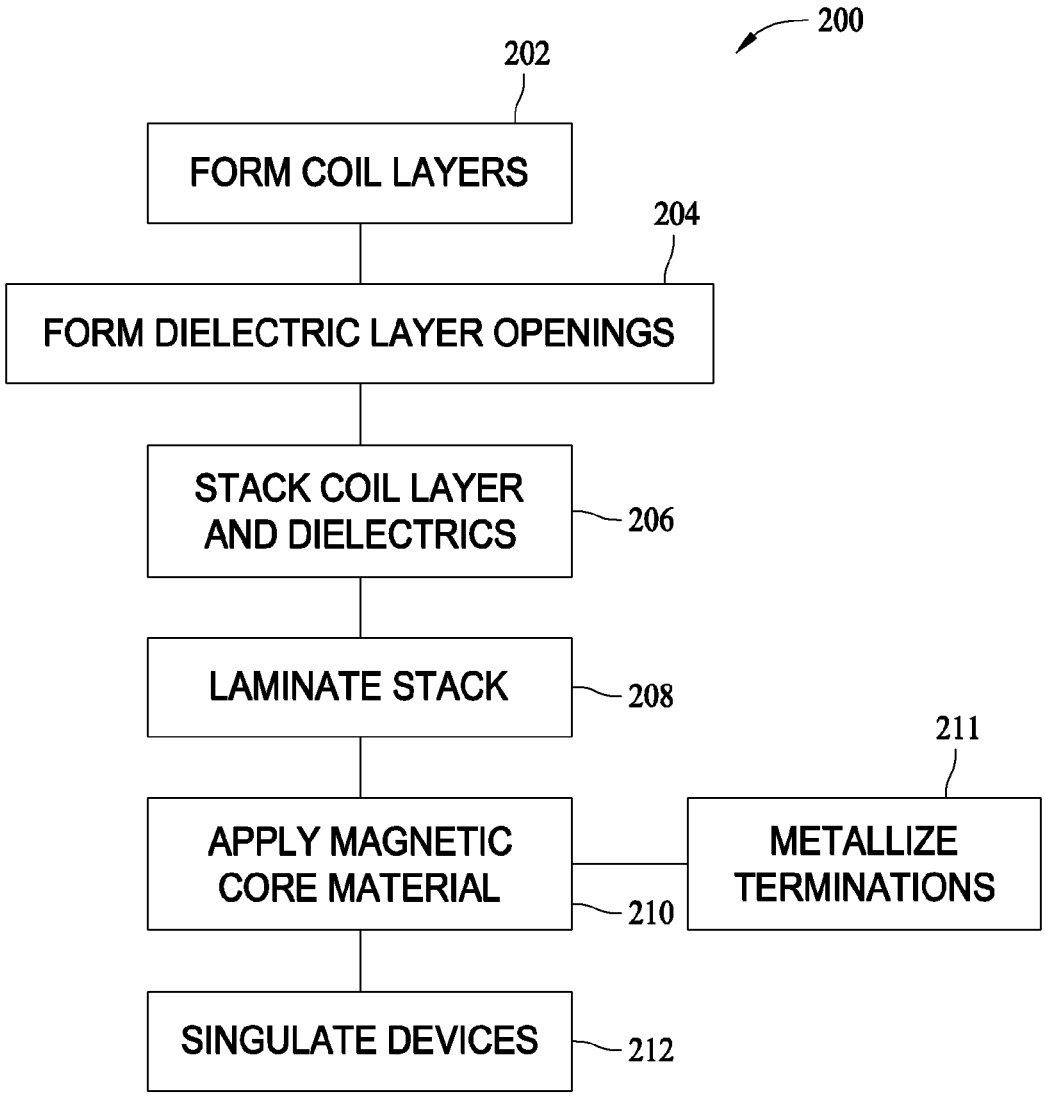
FIG. 5 is a method flowchart of a method of manufacturing the component shown in FIGS. 1-4.

The construction of the inductor also lends itself to subassemblies that may be separately provided and assembled to one another according the following method 200 illustrated in FIG. 5.

The coil windings 130 may be formed 202 in bulk on a larger piece or sheet of a dielectric base layer 132 to form 202 the coil layers 102 on a larger sheet of dielectric material. The windings 130 may be formed in any manner described above, or via other techniques known in the art. The core openings 136 may be formed in the coil layers 102 before or after forming of the coil windings 130. The coil windings 130 may be double sided or single sided as desired, and may be formed with additive electro-formation techniques or subtractive techniques for defining a metallized surface. The coil winding portions 130A and 130B, together with the termination pads 140, 142 and any interconnections 138 (FIG. 3) are provided on the base layer 132 to form 202 the coil layers 102 in an exemplary embodiment.

The dielectric layers 104 and 106 may likewise be formed 204 from larger pieces or sheets of dielectric material, respectively. The core openings 150, 152 in the dielectric layers may be formed in any known manner, including but not limited to punching techniques, and in an exemplary embodiment, the core openings 150, 152 are formed prior to assembly of the layers 104 and 106 on the coil layer.

The sheets including the coil layers 102 from step 202 and the sheets including the dielectric layers 104, 106 formed in step 204 may then be stacked 206 and laminated 208 to form an assembly as shown in FIG. 4. After stacking 206 and/or laminating 208 the sheets forming the respective coil layers 102 and dielectric layers 104 and 106, the magnetic core material may be applied 210 in the pre-formed core openings 136, 150 and 152 in the respective layers to form the cores. After curing the magnetic material, the layered sheets may be cut, diced, or otherwise singulated 212 into individual magnetic components 100. Vertical surfaces 122, 124 of the terminations 114, 116 (FIG. 1) may be metallized 211 via, for example, a plating process, to interconnect the termination pads 140, 142 of the coil layers 102 (FIGS. 2 and 3) to the termination pads 118, 120 (FIG. 1) of the dielectric layer 104.

With the above-described layered construction and methodology, magnetic components such as inductors may be provided quickly and efficiently, while still retaining a high degree of control and reliability over the finished product. By pre-forming the coil layers and the dielectric layers, greater accuracy in the formation of the coils and quicker assembly results in comparison to known methods of manufacture. By forming the core over the coils in the core openings once the layers are assembled, separately provided core structures, and manufacturing time and expense, is avoided. By embedding the coils into the core, separately applying a winding to the surface of the core in conventional component constructions is also avoided. Low profile inductor components may therefore be manufactured at lower cost and with less difficulty than known methods for manufacturing magnetic devices.

It is contemplated that greater or fewer layers may be fabricated and assembled into the component 100 without departing from the basic methodology described above. Using the above described methodology, magnetic components for inductors and the like may be efficiently formed using low cost, widely available materials in a batch process using relatively inexpensive techniques and processes. Additionally, the methodology provides greater process control in fewer manufacturing steps than conventional component constructions. As such, higher manufacturing yields may be obtained at a lower cost.

III. A MODULAR APPROACH

Figure 6:
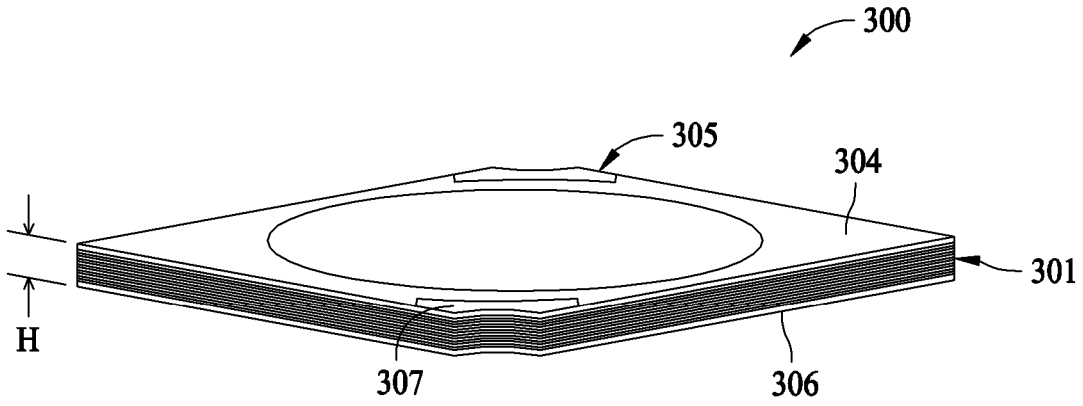
FIG. 6 is a perspective view of another embodiment of a magnetic component according to the present invention.
Figure 7:
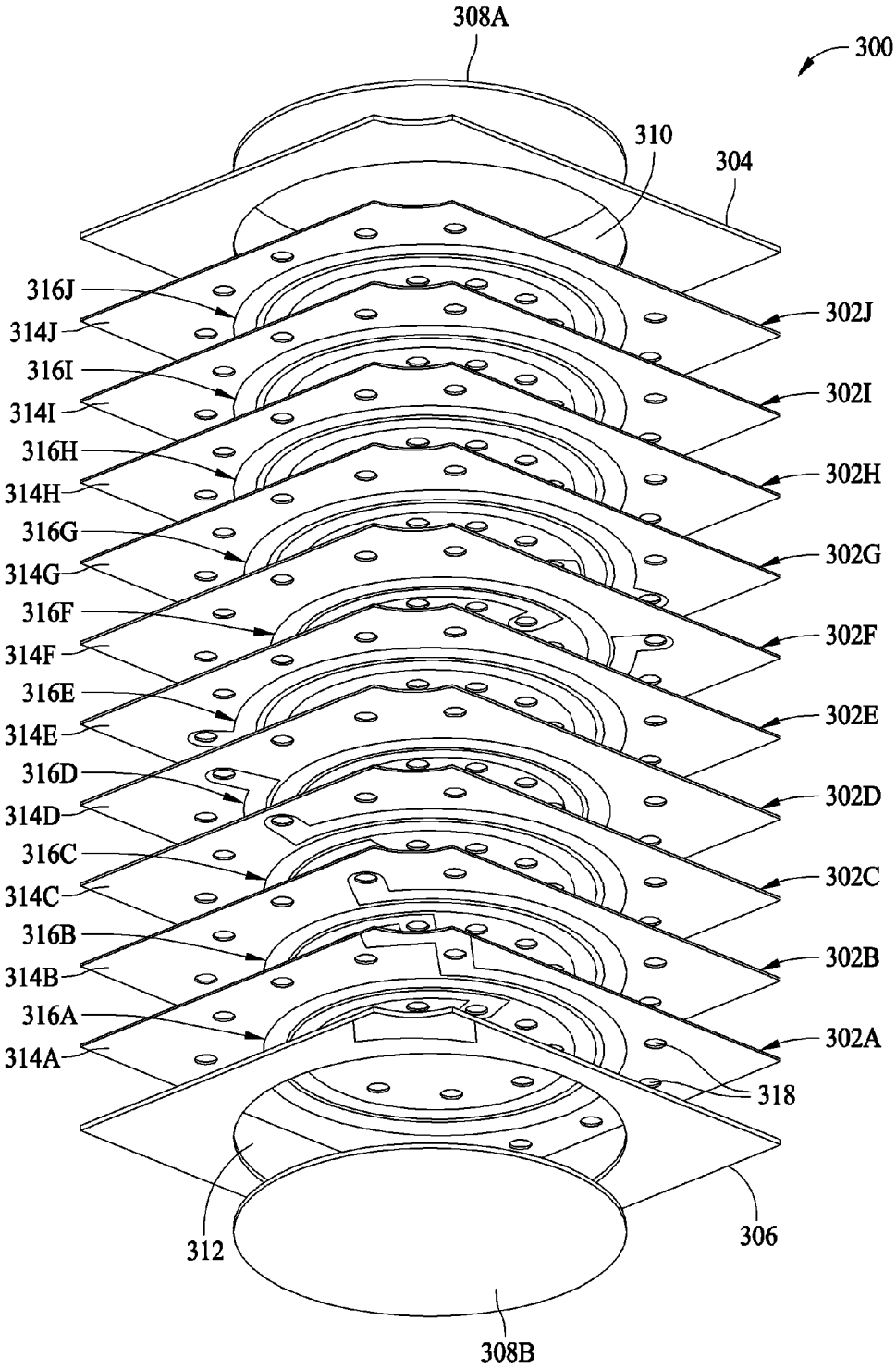
FIG. 7 is an exploded view of the magnetic component shown in FIG. 6.

FIGS. 6 and 7 illustrate another embodiment of a magnetic component 300 including a plurality of substantially similar coil layers stacked upon one another to form a coil module 301 extending between upper and lower dielectric layers 304 and 306. More specifically, the coil module 301 may include coil layers 302A, 302B, 302C, 302D, 302E, 302F, 302G, 302H, 3021 and 302J connected in series with one another to define a continuous current path through the coil layers 302 between surface mount terminations 305, 307, which may include any of the termination connecting structures described above.

Like the component 100 described above, the upper and lower dielectric layers 304 and 306 include pre-formed openings 310, 312 defining receptacles for magnetic core portions 308A and 308B in a similar manner as that described above for the component 100.

Each of the coil layers 302A, 302B, 302C, 302D, 302E, 302F, 302G, 302H, 302I and 302J includes a respective dielectric base layer 314A, 314B, 314C, 314D, 314E, 314F, 314G, 314H, 314I and 314J and a generally planar coil winding portion 316A, 316B, 316C, 316D, 316E, 316F, 316G, 316H, 316I and 316J. Each of the coil winding portions 316A, 316B, 316C, 316D, 316E, 316F, 316G, 316H, 316I and 316J includes a number of turns, such as two in the illustrated embodiment, although greater and lesser numbers of turns may be utilized in another embodiment. Each of the coil winding portions 316 may be single-sided in one embodiment. That is, unlike the coil layer 102 described above, the coil layers 302 may include coil winding portions 316 extending on only one of the major surfaces of the base layers 314, and the coil winding portions 316 in adjacent coil layers 302 may be electrically isolated from one another by the dielectric base layers 314. In another embodiment, double sided coil windings may be utilized, provided that the coil portions are properly isolated from one another when stacked to avoid electrical shorting issues.

Figure 8:
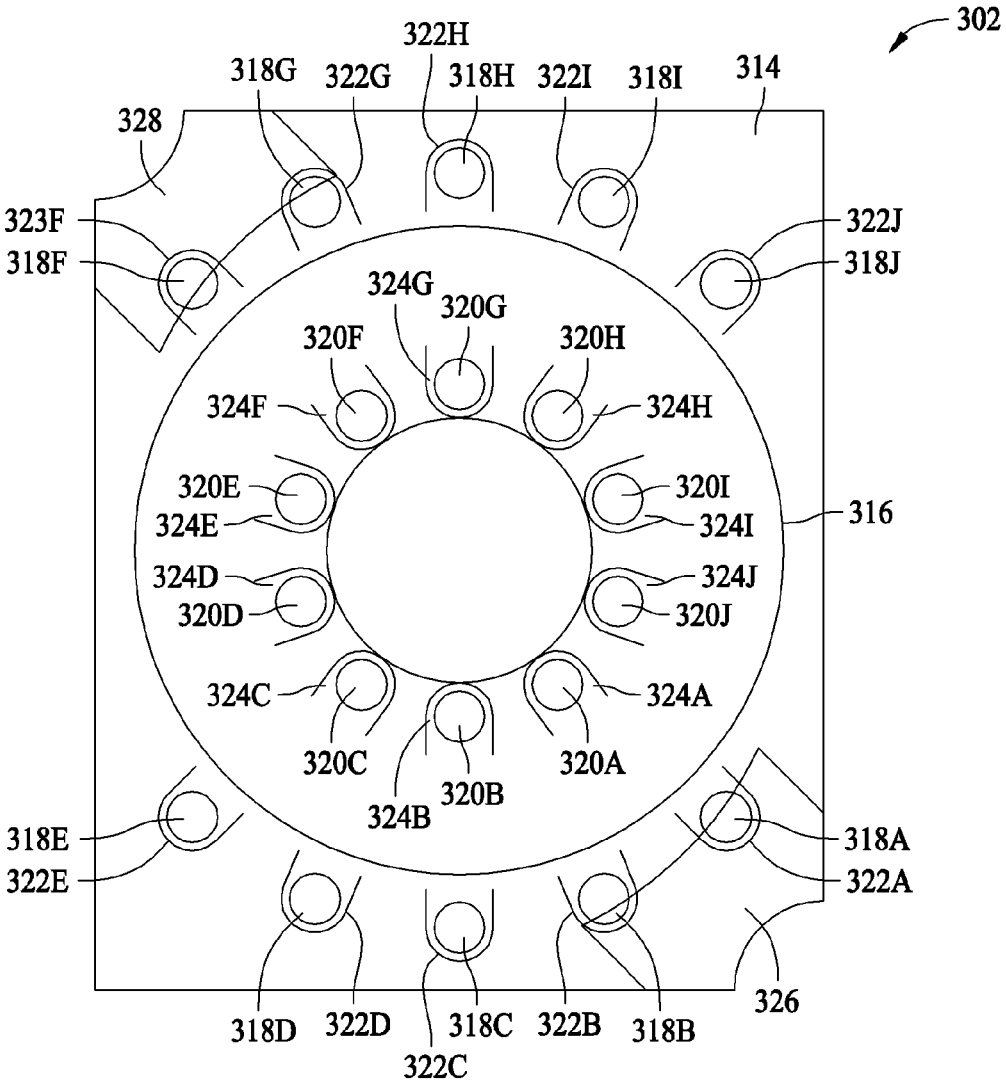
FIG. 8 is a schematic view of a portion of the component shown in FIGS. 6 and 7.

Additionally, each of the coil layers 302 includes termination openings 318 that may be selectively filled with a conductive material to interconnect the coil windings 316 of the coil layers 302 in series with one another in the manner explained below. The openings 318 may, for example, be punched, drilled or otherwise formed in the coil layer 402 proximate the outer periphery of the winding 316. As schematically illustrated in FIG. 8, each coil layer 402 includes a number of outer coil termination openings 318A, 318B, 318C, 318D, 318E, 318F, 318G, 318H, 318I, 318J. In an exemplary embodiment, the number of termination openings 318 is the same as the number of coil layers 302, although more or less termination openings 318 could be provided with similar effect in an alternative embodiment.

Likewise, each coil layer 302 includes a number of inner coil termination openings 320A, 320B, 320C, 320D, 320E, 320F, 320G, 320H, 3201, 320J, that likewise may be punched, drilled or otherwise formed in the coil layers 302. The number of inner termination openings 320 is the same as the number of outer termination openings 318 in an exemplary embodiment, although the relative numbers of inner and outer termination openings 320 and 318 may varied in other embodiments. Each of the outer termination openings 318 is connectable to an outer region of the coil 316 by an associated circuit trace 322A, 322B, 322C, 322D, 322E, 322F, 322G, 322H, 3221, and 322J. Each of the inner termination openings 320 is also connectable to an inner region of the coil 316 by an associated circuit trace 324A, 324B, 324C, 324D, 324E, 324F, 324G, 324H, 324I, and 324J. Each coil layer 302 also includes termination pads 326, 328 and a central core opening 330.

In an exemplary embodiment, for each of the coil layers 302, one of the traces 322 associated with one of the outer termination openings 318 is actually present, and one of the traces 324 associated with one of the inner termination openings 322 is actually present, while all of the outer and inner termination openings 318 and 320 are present in each layer. As such, while a plurality of outer and inner termination openings 318, 320 are provided in each layer, only a single termination opening 318 for the outer region of the coil winding 316 in each layer 302 and a single termination opening 320 for the inner region of each coil winding 316 is actually utilized by forming the associated traces 322 and 324 for the specific termination openings 318, 320 to be utilized. For the other termination openings 318, 320 that are not to be utilized, connecting traces are not formed in each coil layer 302.

As illustrated in FIG. 7, the coil layers 302 are arranged in pairs wherein the termination points established by one of the termination openings 318 and 320 and associated traces in a pair of coil winding portions 316A and 316B, such as in the coil layers 302A and 302B, are aligned with one another to form a connection. An adjacent pair of coil layers in the stack, however, such as the coil layers 302C and 302D, has termination points for the coil winding portions 316C and 316D, established by one of the termination openings 318 and 320 and associated traces in the coil layers of the pair, that are staggered in relation to adjacent pairs in the coil module 301. That is, in the illustrated embodiment, the termination points for the coil layers 302C and 302D are staggered from the termination points of the adjacent pairs 316A, 316B and the pair 316E and 316F. Staggering of the termination points in the stack prevents electrical shorting of the coil winding portions 316 in adjacent pairs of coil layers 302, while effectively providing for a series connections of all of the coil winding portions 316 in each coil layer 302A, 302B, 302C, 302D, 302E, 302F, 302G, 302H, 302I and 302J.

When the coil layers 302 are stacked, the inner and outer termination openings 318 and 320 formed in each of the base layers 314 are aligned with another, forming continuous openings throughout the stacked coil layers 302. Each of the continuous openings may be filled with a conductive material, but because only selected ones of the openings 318 and 320 include a respective conductive trace 322 and 324, electrical connections are established between the coil winding portions 316 in the coil layers 302 only where the traces 322 and 324 are present, and fail to establish electrical connections where the traces 322 and 324 are not present.

In the embodiment illustrated in FIG. 7, ten coil layers 302A, 302B, 302C, 302D, 302E, 302F, 302G, 302H, 302I and 302J are provided, and each respective coil winding portion 316 in the coil layers 302 includes two turns in the illustrated embodiment. Because the coil winding portions 316A, 316B, 316C, 316D, 316E, 316F, 316G, 316H, 316I and 316J are connected in series, twenty total turns are provided in the stacked coil layers 302. A twenty turn coil may produce an inductance value of about 4 to 5 μH in one example, rendering the inductor 100 well suited as a power inductor for low power applications. The component 300 may alternatively be fabricated, however, with any number of coil layers 302, and with any number of turns in each winding portion of the coil layers to customize the coil for a particular application or end use.

The upper and lower dielectric layers 304, 306, and the base dielectric layers 314 may be fabricated from polymer based metal foil materials as described above with similar advantages. The coil winding portions 316 may be formed any manner desired, including the techniques described above, also providing similar advantages and effects. The coil layers 302 may be provided in module form, and depending on the number of coil layers 302 used in the stack, inductors of various ratings and characteristics may be provided. Because of the stacked coil layers 302, the inductor 300 has a greater low profile dimension H (about 0.5 mm in an exemplary embodiment) in comparison to the dimension H of the component 100 (about 0.15 mm in an exemplary embodiment), but is still small enough to satisfy many low profile applications for use on stacked circuit boards and the like.

Figure 9:
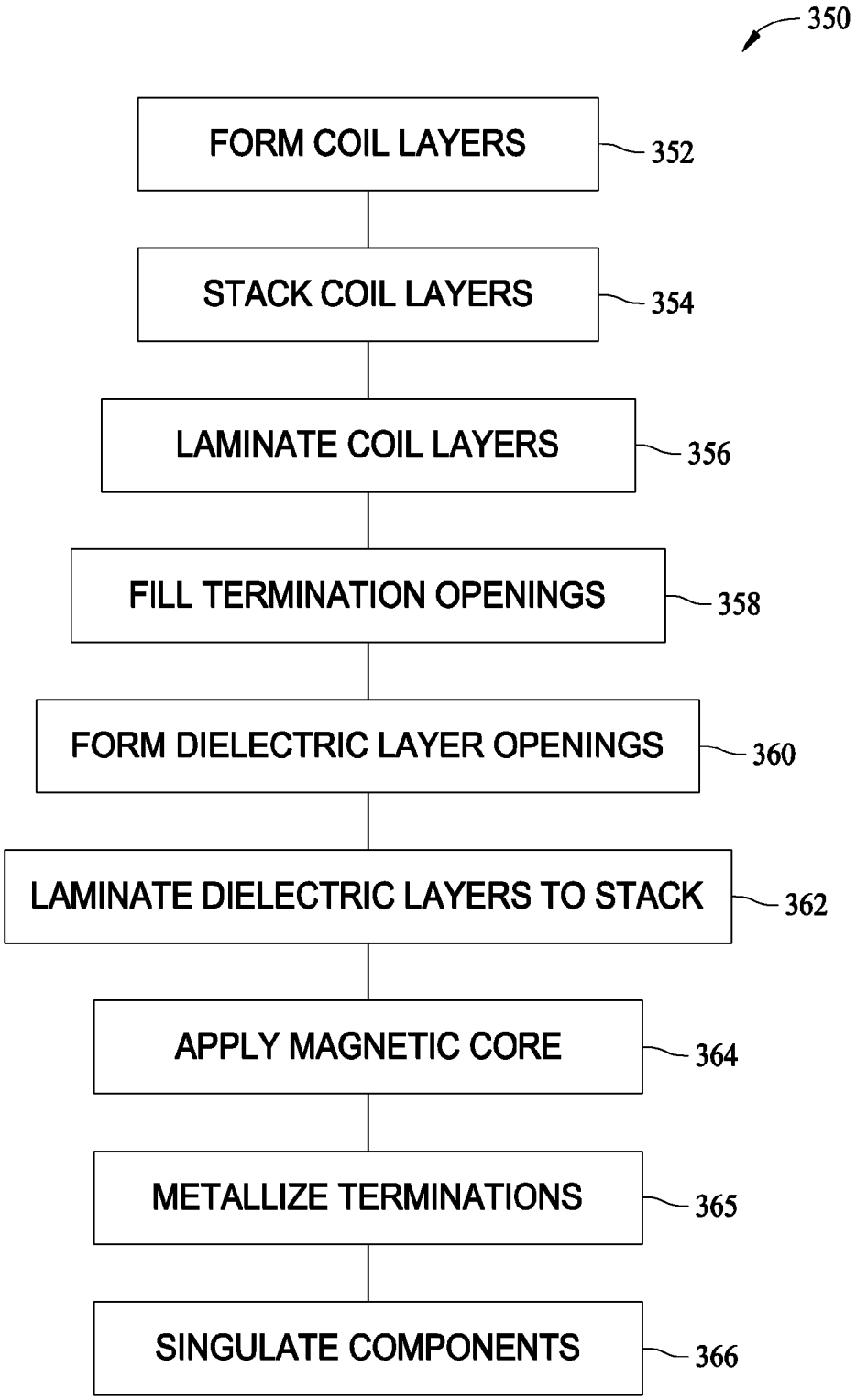
FIG. 9 is a method flowchart of a method of manufacturing the component shown in FIGS. 6-8.

The construction of the component 300 also lends itself to subassemblies that may be separately provided and assembled to one another according the following method 350 illustrated in FIG. 9.

The coil windings may be formed in bulk on a larger piece of a dielectric base layer to form 352 the coil layers 302 on a larger sheet of dielectric material. The coil windings may be formed in any manner described above or according to other techniques known in the art. The core openings 330 may be formed into the sheet of material before or after forming of the coil windings. The coil windings may be double sided or single sided as desired, and may be formed with additive electro-formation techniques or subtractive techniques on a metallized surface. The coil winding portions 316, together with the termination traces 322, 324 and termination pads 326, 328 are provided on the base layer 314 in each of the coil layers 302. Once the coil layers 302 are formed in step 352, the coil layers 302 may be stacked 354 and laminated 356 to form coil layer modules. The termination openings 318, 320 may be provided before or after the coil layers 302 are stacked and laminated. After they are laminated 356, the termination openings 318, 320 of the layers may be filled 358 to interconnect the coils of the coil layers in series in the manner described above.

The dielectric layers 304 and 306 may also be formed 360 from larger pieces or sheets of dielectric material, respectively. The core openings 310, 312 in the dielectric layers 304, 306 may be formed in any known manner, including but not limited to punching or drilling techniques, and in an exemplary embodiment the core openings 310, 312 are formed prior to assembly of the dielectric layers 304 and 306 to the coil layer modules.

The outer dielectric layers 304 and 306 may then be stacked and laminated 362 to the coil layer module. Magnetic core material may be applied 364 to the laminated stack to form the magnetic cores. After curing the magnetic material, the stacked sheets may be cut, diced, or otherwise singulated 366 into individual inductor components 300. Before or after singulation of the components, vertical surfaces of the terminations 305, 307 (FIG. 7) may be metallized 365 via, for example, a plating process, to complete the components 300.

With the layered construction and the method 350, magnetic components such as inductors and the like may be provided quickly and efficiently, while still retaining a high degree of control and reliability over the finished product. By pre-forming the coil layers and the dielectric layers, greater accuracy in the formation of the coils and quicker assembly results in comparison to known methods of manufacture. By forming the core over the coils in the core openings once the layers are assembled, separately provided core structures, and manufacturing time and expense, is avoided. By embedding the coils into the core, a separate application of a winding to the surface of the core is also avoided. Low profile inductor devices may therefore be manufactured at lower cost and with less difficulty than known methods for manufacturing magnetic devices.

It is contemplated that greater or fewer layers may be fabricated and assembled into the component 300 without departing from the basic methodology described above. Using the above described methodology, magnetic components may be efficiently formed using low cost, widely available materials in a batch process using relatively inexpensive known techniques and processes. Additionally, the methodology provides greater process control in fewer manufacturing steps than conventional component constructions. As such, higher manufacturing yields may be obtained at a lower cost.

For the reasons set forth above, the inductor 300 and method 350 is believed to be avoid manufacturing challenges and difficulties of known constructions and is therefore manufacturable at a lower cost than conventional magnetic components while providing higher production yields of satisfactory devices.

IV. CONCLUSION

While the invention has been described in terms of various specific embodiments, those skilled in the art will recognize that the invention can be practiced with modification within the spirit and scope of the claims.

What is claimed is:

1. A method of manufacturing a chip inductor configured as a power management device for an electrical system of an electronic device, the chip inductor including a coil winding and a core structure therefor, the method comprising:

providing at least one prefabricated coil winding having a number of turns;

providing a plurality of flexible dielectric sheet layers, wherein the at least one prefabricated coil winding is fabricated independently of any of the plurality of flexible dielectric sheet layers, and wherein each of the flexible dielectric sheet layers include a core opening;

assembling the at least one prefabricated coil winding with the plurality of flexible dielectric sheet layers by stacking the plurality of flexible dielectric sheet layers while the flexible dielectric sheet layers are in a solidified state;

laminating the plurality of flexible dielectric sheets around the at least one prefabricated coil winding to form a dielectric body having a low profile chip configuration, wherein the core opening exposes the at least one prefabricated coil winding; and providing surface mount circuit terminations on an exterior of the dielectric body, the surface mount circuit terminations attachable to a circuit board of the electronic device and completing an electrical path from the circuit board through the least one prefabricated coil winding when mounted to the circuit board; and applying a magnetic core material in the core opening.

2. The method of claim 1, wherein assembling the at least one prefabricated coil winding with the plurality of flexible dielectric sheet layers comprises stacking the plurality of flexible dielectric sheet layers with the at least one prefabricated coil winding interposed between at least two of the flexible dielectric sheet layers.

3. The method of claim 1, wherein laminating the plurality of flexible dielectric sheet layers comprises pressure laminating the plurality of flexible dielectric sheets around the at least one prefabricated coil winding.

4. The method of claim 1, wherein the flexible dielectric sheet layers comprise a polymer based dielectric film, and laminating the polymer based film comprises adhesively laminating the plurality of dielectric sheets.

5. The method of claim 1, wherein the flexible dielectric sheet layers comprise a polymer based dielectric film, and laminating the polymer based film comprises adhesivelessly laminating the plurality of dielectric sheets.

6. The method of claim 1, wherein the at least one coil winding is prefabricated on a planar dielectric substrate layer, and the method further comprises assembling the planar dielectric substrate layer with the plurality of flexible dielectric sheet layers.

7. The method of claim 1, wherein providing the at least one prefabricated coil winding comprises providing a prefabricated coil winding having a number of turns extending around an open center area.

8. The method of claim 7, further comprising applying the magnetic core material, separately provided and distinct from the plurality of flexible dielectric sheets, into at least the open center area.

9. The method of claim 8, wherein applying the magnetic core material comprises introducing a magnetic powder material to the open center area.

10. The method of claim 9, wherein introducing the magnetic powder material comprises to the open center area comprises introducing an iron powder material to the open center area.

11. The method of claim 1, wherein laminating the plurality of flexible dielectric sheets around the at least one prefabricated coil winding to form the dielectric body having the low profile chip configuration comprises:

laminating the plurality of flexible dielectric sheets around a batch of prefabricated coil windings to form a dielectric body; and singulating the laminated dielectric body into discrete power inductor components each having the low profile chip configuration and at least one of the prefabricated coil windings in the batch.

12. The method of claim 11, wherein singulating the laminated dielectric body comprises singulating the laminated dielectric body to obtain at least one discrete power inductor component having the low profile chip configurations and only one of the prefabricated coil windings.

13. The method of claim 1, wherein providing at least one prefabricated coil winding comprises providing a plurality of prefabricated coil windings, and assembling the plurality of prefabricated coil windings with the plurality of flexible dielectric sheet layers.

14. The method of claim 13, further comprising connecting each of the prefabricated coil windings in series.

15. The method of claim 13, wherein the applying of the magnetic core material comprises embedding a magnetic core piece in the dielectric body.

16. The method of claim 15, wherein a portion of the magnetic core piece extends through the at least one prefabricated coil winding.

17. The method of claim 15, wherein providing the at least one prefabricated coil winding comprises providing at least one prefabricated coil winding having opposing sides defined by a rounded inner periphery and a rounded outer periphery, and an open center being substantially coextensive with the inner periphery.

18. The method of claim 17, wherein embedding the magnetic core piece comprises embedding a first portion of the core piece configured to extend to the rounded outer periphery, and embedding a second portion of the core piece configured to extend to the open center.

19. The method of claim 15, wherein the magnetic core piece is fabricated from a different material than the flexible dielectric sheet layers.

20. The method of claim 15, wherein the magnetic core piece is fabricated from a magnetic powder material.

21. The method of claim 20, wherein the magnetic core piece is fabricated from an iron powder material.

22. The method of claim 15, wherein laminating the plurality of flexible dielectric sheets around the at least one prefabricated coil winding to form the dielectric body comprises laminating the plurality of flexible dielectric sheets around only one prefabricated coil.

23. The method of claim 15, wherein the magnetic core piece embeds only one coil winding.

24. The method of claim 1, further comprising:

forming the magnetic core material into a cylindrical core piece for the at least one prefabricated coil winding.

25. The method of claim 24, wherein providing the at least one prefabricated coil winding comprises providing at least one prefabricated coil winding having opposing sides defined by a rounded inner periphery and a rounded outer periphery, and an open center being substantially coextensive with the inner periphery.

26. The method of claim 25, wherein forming the magnetic core material comprises forming a first portion of the core piece to be a generally circular core portion extending to the rounded outer periphery, and forming a second portion of the core piece to extending only to the inner periphery.

27. The method of claim 24, wherein providing the magnetic core material comprises providing a magnetic material fabricated from a different material than the flexible dielectric sheet layers.

28. The method of claim 24, wherein providing the magnetic core material comprises providing magnetic powder material.

29. The method of claim 28, wherein providing the magnetic powder material comprises providing an iron powder material.

30. The method of claim 1, wherein the core opening exposes only one prefabricated coil winding.

31. The method of claim 1 wherein assembling the at least one prefabricated coil winding with the plurality of flexible dielectric sheet layers comprises stacking the plurality of flexible dielectric sheet layers in surface engagement with one another while the flexible dielectric sheet layers are in a solidified state.

32. The method of claim 1 wherein providing at least one prefabricated coil winding comprises providing a prefabricated coil having a plurality of turns.

* * * * *

UNITED STATES PATENT AND TRADEMARK OFFICE

CERTIFICATE OF CORRECTION

PATENT NO. : 8,484,829 B2
APPLICATION NO. : 12/724490
DATED : July 16, 2013
INVENTOR(S) : Daniel Minas Manoukian and Robert James Bogert It is certified that error appears in the above-identified patent and that said Letters Patent is hereby corrected as shown below:

On the Title page, in item (54), and in the Specification, Column 1, lines 1-3, the Title, delete "METHODS FOR MANUFACTURING MAGNETIC COMPONENTS HAVING LOW PROBILE LAYERED COIL AND CORES" and insert therefor -- METHODS FOR MANUFACTURING MAGNETIC COMPONENTS HAVING LOW PROFILE LAYERED COIL AND CORES --.

Signed and Sealed this
Twenty-ninth Day of October, 2013

Teresa Stanek Rea

Teresa Stanek Rea
*Deputy Director of the United States Patent and Trademark Office*